United States Patent [19]

Doi et al.

[11] Patent Number: 4,748,078

[45] Date of Patent: May 31, 1988

[54] WARP KNITTED LACE FABRICS

[75] Inventors: Ichiro Doi, Nishinomiya; Katsuhiko Ichii, Takarazuka, both of Japan

[73] Assignee: Sakae Lace Co., Ltd., Takarazuka, Japan

[21] Appl. No.: 938,291

[22] Filed: Dec. 5, 1986

[30] Foreign Application Priority Data

Dec. 5, 1985 [JP] Japan ..... 60-274805
Apr. 2, 1986 [JP] Japan ..... 61-077172
Jul. 2, 1986 [JP] Japan ..... 61-157052

[51] Int. Cl.[4] ..... D03D 15/00; D04B 1/08

[52] U.S. Cl. ..... 428/245; 428/253; 428/254; 428/267; 66/169 A; 66/195; 66/202

[58] Field of Search ..... 428/32, 37, 245, 254, 428/267, 365, 474.7, 474.9, 475.5, 253; 66/169 R, 169 A, 195, 202; 525/30, 38, 39

[56] References Cited

U.S. PATENT DOCUMENTS 4,119,680 10/1978 Vachon ..... 66/169 R

FOREIGN PATENT DOCUMENTS 2016851 11/1970 Fed. Rep. of Germany ... 66/169 A
2523772 12/1976 Fed. Rep. of Germany ... 66/169 A
2723291 11/1978 Fed. Rep. of Germany ... 66/169 A
0057734 4/1984 Japan ..... 428/254

OTHER PUBLICATIONS

Shaw, Ronald, "The Non-Run Fabric", *Hosiery and Underwear*, Sep. 1972.

*Primary Examiner*—John E. Kittle
*Assistant Examiner*—Beth A. Bozzelli
*Attorney, Agent, or Firm*—Millen & White

[57] ABSTRACT

A warp knitted lace fabric comprising a plurality of chain stitches and a ground insertion yarn, pattern yarn and/or other yarn interconnecting said chain stitches, said plurality of chain stitches being made either as a whole or in part by a heat bonding yarn comprising a lace knitting yarn carrying a low-melting thermoplastic synthetic resin covering and said heat bonding yarn being thermally jointed to itself or to other component yarns at intersections.

9 Claims, 3 Drawing Sheets

WARP KNITTED LACE FABRICS

BACKGROUND OF THE INVENTION

1. Field of the Invention

The present invention relates to a warp-knitted lace fabric constructed with a raschel warp loom.

2. Description of the Prior Art

The lace fabric manufactured using a raschel warp loom is such that a plurality of chain stitches in the wale direction and a ground insertion yarn interposed between needle loops and loop legs thereof and traversing from one wale to another constitute a ground texture and, if necessary, a pattern yarn is inserted between said needle loops and loop legs in optional positions to knit a pattern or a fringe yarn is interposed to make a fringe. With such a warp knitted lace fabric, it is well known that breakage of a yarn constituting chain stitches and subsequent pulling of the cut end cause a slip-off of the latest needle loop subsequent to the cut end from the immediately preceding needle loop and as this slip-off effect propagates to the older loops, a series of stitches are lost to cause the so-called "run". As a run-proof knitted fabric, Japanese Utility Model Publication No. 47-20306 describes a fabric constructed by knitting a twisted yarn or double yarn of two threads having different softening points and heat-setting the low-softening stread at intersecting points. Further, Japanese Utility Model Publication No. 55-176389 teaches a warp-knitted lace fabric constructed by doubling a heat-bonding thread and a regular thread to prepare a warp yarn, knitting the same into chain stitches and heating the thermally bondable thread at the junctions of the warp yarn with a shogging yarn (weft yarn). Further, Japanese Patent Kokai Nos. 60-39458 and 60-65162 describe the warp knitted lace fabrics made by reciprocating a warp yarn constituting chain stitches between wales, wherein the warp yarn forms several courses of chain stitches per wale and, then, moves to the next adjoining wale to form further chain stitches. The warp knitted fabric described in Japanese Utility Model Publication No. 47-20306 and Japanese Utility Model Kokai No. 55-176389, that is a fabric constructed by douling a low-softening thread and an ordinary thread, knitting the same and heat-setting the fabric, has the disadvantage that as the low-softening yarn or heat-bonding yarn sticks to the regular yarn all over to cause a hard hand so that the technique cannot be applied to the warp knitted lace fabric which demands a soft hand. If the amount of the heat-bonding or low-softening yarn is reduced, breakage of a single regular yarn immediately resulted in a run.

SUMMARY OF THE INVENTION

The present invention provides a warp knitted lace fabric comprising a plurality of chain stitches and a ground insertion yarn, pattern yarn and/or other yarn interconnecting said chain stitches, said plurality of chain stitches being made by a ground or foundation yarn which is wholly or partially comprised of a heat bonding fiber consisting in an ordinary lace yarn carrying a low-melting thermoplastic synthetic resin surface covering, and said heat bonding yarn being thermally bonded to each other or to other component yarns at junctions.

Preferably, said heat bonding yarn is a nylon filament yarn having a thermoplastic synthetic resin covering of, preferably, a nylon 6-nylon 66-nylon 12 terpolymer having a melting point of 110 to 120° C.

The above-mentioned heat bonding yarn may comprise all of the ground or foundation yarn forming the chain stitches or may account for only a part thereof. In the latter case, the ordinary lace yarn having no low-melting thermoplastic synthetic resin covering and said heat bonding yarn maybe used as a first and a second yarn and both yarns being doubled so as to form the common stitches. Instead, the first and second yarns may be independently fed so that they may form independent loops. When said first and second yarns are doubled to form common stitches, it may be so arranged that either one of said first and second yarns reciprocates between wales and, in each wale, forms chain stitches with the other yarn. In this case, said one yarn reciprocating between wales is preferably finer than the other yarn, for example not greater than 30 deniers, and is desirably knitted at a lower tension than is the other yarn.

DESCRIPTION OF THE PREFERRED EMBODIMENTS

The heat bonding yarn which is used at least as a part of the ground or foundation yarn in the present invention is a yarn consisting of a regular lace knitting yarn as a core and a low-melting thermoplastic synthetic resin coat as a surface covering layer.

The low-melting thermoplastic synthetic resin may be a resin that melts at a temperature below the melting or decomposition temperature of the ordinary lace yarn constituting the ground insertion yarn, pattern yarn, fringe yarn and the like, and copolymer resins of the polyamide type or polyester type may be mentioned by way of example.

The heat bonding yarn mentioned above can be obtained by melting the low-melting thermoplastic synthetic resin or dissolving it in a solvent, applying the melt or solution to the desired lace yarn by means of a sizing roller or by coating, for instance, and drying the coated yarn. As an alternative procedure, the above-mentioned lace yarn is caused to travel in contact with the above-mentioned thermoplastic resin and dried by means of a hot-air dryer or a heating roll. Depending on the amount of deposition of solid contents, the thermoplastic resin alters the hard or feeling of the knitted lace structure. The preferred proportion of said solid contents is 7 to 35 percent by weight relative to the core lace yarn. If the proportion is less than 7%, no sufficient adhesion can be obtained, while more than 35% will give rise to a harsh hand. However, when chain stitches are made with two threads, one of which is said heat-bonding yarn, the minimum deposition amount may be as low as 1 percent by weight.

Figure 1:
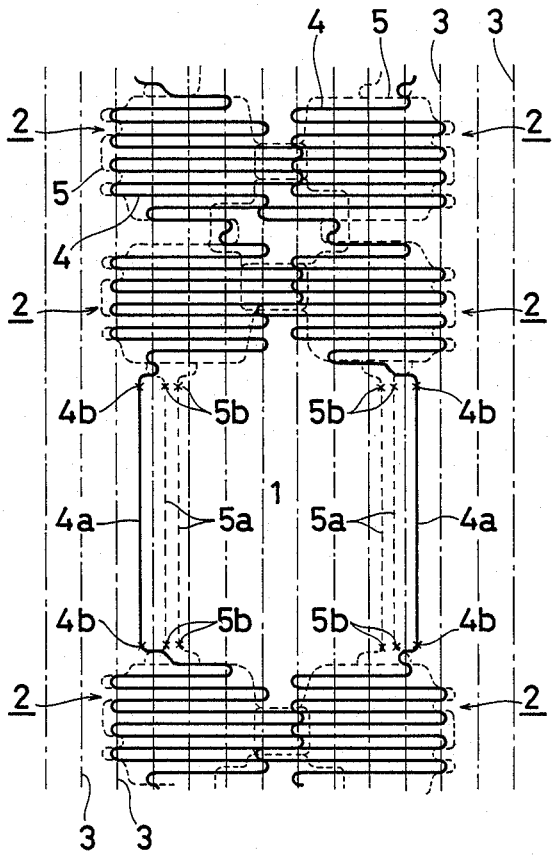
FIG. 1 is a schematic view illustrating the raschel lace fabric according to the present invention.
Figure 2:
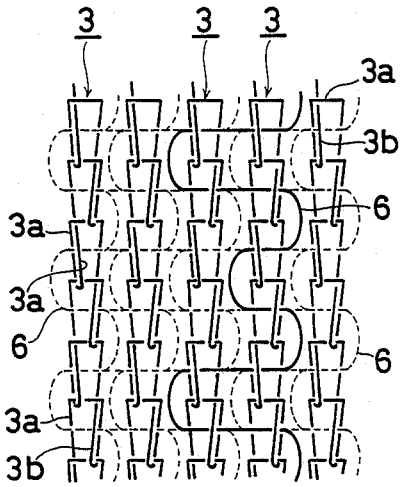
FIG. 2 is a pattern view showing the ground part of FIG. 1 on a exaggerated scale.

In the first embodiment of the present invention, a raschel machine (Karl-Meyer RMS-26) was used to knit a raschel lace a illustrated in FIG. 1. In the illustration, 1 denotes the net-like ground section, 2 a pattern-knit section, 3 a chain-knit section, 4 a pattern-knit yarn, and 5 a fringe yarn. As shown in FIG. 2, the ground section 1 is formed by interconnecting two chain stitches 3, 3 with ground insertion yarn 6. In FIG. 2, one ground insertion yarn 6 is shown by the solid line, while the other ground insertion yarns are indicated by broken lines. In FIG. 1, the ground insertion yarn 6 is omitted. However, in the pattern-knit section 2 of FIG. 1, just like the ground insertion yarn 6 in FIG. 2, the pattern yarn 4 and fringe yarn 5 are inserted and supported between the needle loop 3*a* and loop leg 3*b* of the chain stitch 3 and the traversing portions 4*a*, 5*a* of pattern yarn 4 and fringe yarn 5 between the upper and lower two separate pattern-knit sections 2, 2 are floated and, after final construction, cut at ends 4*b*, 5*b* for removal. A 30-denier nylon multifilament yarn was coated uniformly along its length with a methanol solution (20% concentration at 27° C.) of a low-melting thermoplastic resin consisting in a terpolymer of nylon 6, nylon 66 and nylon 12 (tradename: Elder, Toray, Ltd., m.p. 120° C.) followed by drying to give a heat-bonding yarn carrying 17% of said resin on a nonvolatile matter basis. A knitted fabric was constructed using this heat-bonding yarn as the yarn constituting said chain stitch 3, a 40-denier nylon multifilament yarn as said ground insertion yarn 6, a 140-denier nylon multifilament yarn crimped by the stuffing box method as said pattern yarn 4, and a 210-denier nylon multifilament yarn similarly crimped as said fringe yarn 5. The fabric was heat-set at 170° C. under dry heat conditions for 90 seconds so as to melt the surface coating (low-melting thermoplastic resin) of the heat-bonding yarn constituting the chain stitch 3 and, thereafter, dyed, dried and finished in the conventional manner.

Since, in the finished product, the surface coating of the heat-bonding yarn constituting the chain stitch 3 has been bonded to all the ground insertion yarn 6, pattern yarn 4 and fringe yarn 5 at intersections, there is no problem of "runs". Furthermore, even after trimming-off of the traversing portions 4*a*, 5*a* of the pattern yarn 4 and fringe yarn 5, runs do not originate at cut ends 4*b*, 5*b* to cause a change in pattern. Since, in this embodiment, all the chain stitches 3 are made with the heat-bonding yarn, the resin treatment which is routinely carried out as a finishing operation can be omitted.

In another embodiment, a first ordinary yarn and a second heat-bonding yarn are used together as the ground yarn. A 20-denier nylon wooly yarn is coated with a low-melting synthetic resin (m.p. 120° C.) consisting in a terpolymer of nylon 6, nylon 66 and nylon 12 at a coverage of 5 w.t.% nonvolatile matter to give a heat-bonding yarn 12 (the second ground yarn). On the other hand, a 20-denier nylon multifilament yarn is used as the first yarn 11. Douling is carried out using these first and second yarns. The doubled yarn is fed to a Raschel warp loom (Myer RMSJ 78/1-SG) to construct chain-stitches 13. Then, a 40-denier nylon multifilament yarn as the ground yarn (not shown) is interposed between the needle loop 13*a* and loop leg 13*b* of the above chain stitch 13 and the fabric is heat-set at 190° C. for 20 seconds to fuse the contact parts of the heat-bonding yarn 12 to give a construction illustrated in FIG. 3.

The resulting warp knitted fabric has a soft hand because of the low content of said low-boiling synthetic resin and yet, because the heat-bonding threads have been fused together, there occur no runs after cutting with a pair of scissors. When sewn, too, even if the sewing machine needle causes breakage of either one of the first yarn 11 and second heat-bonding yarn 12, there occurs no "run" problem. Furthermore, even when both of the first yarn 11 and second heat-bonding yarn 12 are intentionally cut and the cut ends are pulled, the heat-fused portion is severed when the pulling force is great but because of the high resistance to pulling of the heat-bonding yarn 12, only the needle loop of the first yarn 11 slips off the needle loop below, with the slip-off of the needle loop of the heat-bonding yarn 12 is delayed, thus preventing propagation of the run.

In the above embodiment, the ordinary first yarn 11 and the heat-bonding yarn 12 are preliminarily doubled, taken up on a single beam and fed through the same reeds but the above-mentioned two yarns may be taken up on independent reeds and knitted using the same or different reeds.

Figure 3:
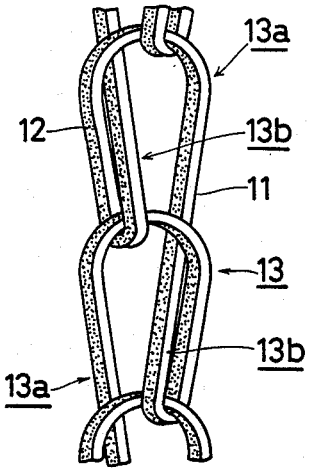
FIG. 3 is an enlarged view showing a chain stitch made in common by doubling a heat bonding yarn and an ordinary yarn.
Figure 5:
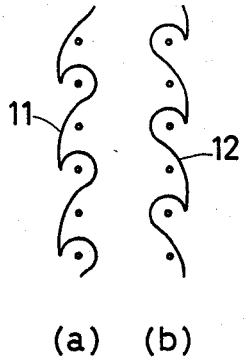
FIG. 5 is a pattern view showing the warp knitted lace fabric according to the enbodiment of FIG. 4.
Figure 4:
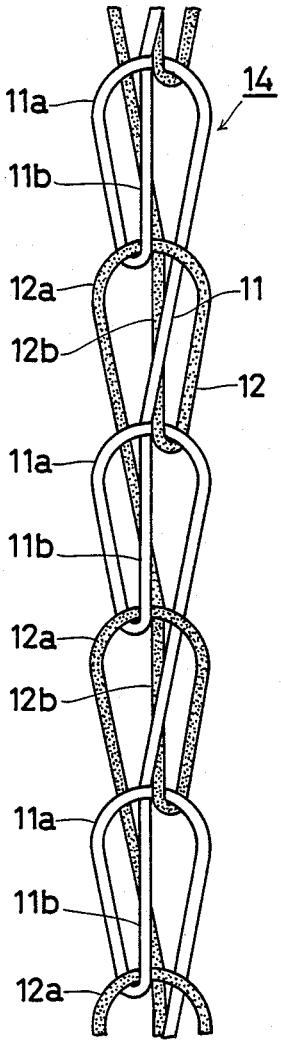
FIG. 4 is an enlarged view showing chain stitches made independently by the heat bonding yarn and ordinary yarn.

The same first yarn 11 and heat-bonding yarn 12 as those used in the embodiment of FIG. 3 were fed to the same warp knitting loom to construct the chain-stitches 14 illustrated in FIG. 4 and 5. Then, the same ground insertion yarn as that used in the above-mentioned embodiment (not shown) was inserted, followed by heat treatment, to give a knitted fabric as illustrated in FIG. 4. Thus, the first yarn 11 and heat-bonding yarn 12 were respectively fed to a first and a second reed, respectively. Using the first reed, the yarn 11 was constructed into the 02/22/02/22 pattern as illustrated in FIG. 5 (*a*), and using the second reed, the heat-bonding yarn 12 was constructed into the 00/20/00/20 pattern as illustrated in FIG. 5 (*b*). Thus, one chain-stitch 14 was formed alternately of the two different yarns 11 and 12 (See FIG. 4). The ground insertion yarn was inserted in the 44/00/44/22 pattern using a third reed. In the warp knitted fabric according to this embodiment, the two different yarns 11 and 12 are alternatingly forming needle loops 11*a* and 12*a*, with the result that even if one of the yarns is cut and the cut end is pulled with force to detach the bond, the run is prevented as the loop leg 12*b* or 11*b* of one yarn 11 or 12 remains inserted in the needle loop 11*a* or 12*a* of the other yarn 11 or 12. Moreover, when the two yarns 11 and 12 are simultaneously cut and the cut ends are pulled, the run stops at the bond and when the cut ends are further pulled with force till the bond fails, the difference in resistance to pulling between the two yarns 11, 12 serves to prevent propagation of the run just as mentioned in connection with the embodiment shown in FIG. 3.

Figure 6:
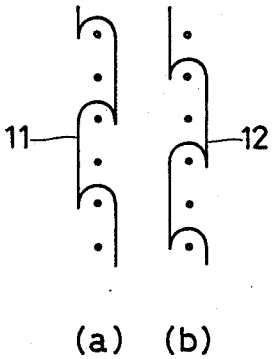
FIGS. 6 and 7 are pattern diagrams according to other embodiments

A warp knitted fabric was constructed in the same manner as the embodiment of FIG. 4 except that a chain stitch of FIG. 6 was used. Thus, using the first reed, the first ordinary yarn 11 was constructed in the 00/02/22/20 pattern as illustrated in FIG. 6(*a*) and using the second reed, the second heat-bonding yarn 12 was constructed in the 02/22/20/00 pattern as illustrated in FIG. 6(*b*). In this connection, insertion of the ground insertion yarn is somewhat difficult as compared with the embodiment of FIG. 4 but the run is prevented in the same manner as in the embodiment illustrated in FIG. 4, and the resulting warp knitted fabric was suitable for inner wear use.

Figure 7:
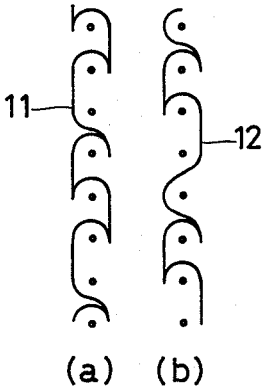

Further, a warp-knitted fabric was constructed in the same manner as the embodiment of FIG. 4 except that a chain stitch shown in FIG. 7 was used. Thus, using the first reed, the first yarn 11 was constructed in the 20/22/20/02 pattern as illustrated in FIG. 7(*a*) and using the second reed, the heat-bonding yarn 12 was constructed in the 00/02/20/22 pattern as illustrated in FIG. 7(*b*). Thus, one chain stitch was formed of two yarns 11 and 12. In this case, the heat-bonding yarn 12 is merely inserted without forming loops in the fourth course but as the heat-bonding yarn 12 is heat-welded at points of contact, the run is prevented in the same manner as in the embodiments described hereinbefore. Of course, the first yarn 11 and the second heat-bonding yarn 12 may be exchanged with each other in the foregoing embodiments described with reference to FIGS. 3 to 7.

A further embodiment is described below, reference being had to FIGS. 8 and 9. In this embodiment, a plurality of chain stitches as arranged in the wale direction and a ground insertion yarn reciprocating between the wales constitute the fabric. The chain stitch 21 is formed in a doubled form using a first warp yarn 22 and a second finer warp yarn 23 not greater than 30 deniers. However, the first warp yarn 22 does not extend to the adjacent wale but constructs only one wale and the second warp yarn 23 reciprocates between a plurality of wales and, along with the first warp yarn 22, constitutes a chain stitch 21 for a few courses per wale. As in the embodiment illustrated in FIG. 3, one of the first warp yarn 21 and the second warp yarn 22 is an ordinary yarn and the other is a heat-bonding yarn. Preferably, the first warp yarn 22 is a heat-bonding yarn and the second warp yarn 23 is an ordinary yarn which is finer than the first warp yarn 22 and is knitted with a tension weaker than the first warp yarn 22. Since, in this embodiment, the chain stitch 21 of each wale is formed of two warp yarns 22 and 23 and these yarns 22 and 23 doubly form the chain stitch loops 21, the run is prevented even if either one of the yarns 22 and 23 is cut, for the other yarn remains unaffected.

Further, when the two warp yarns 22 and 23 are simultaneously cut, the run stops at the part 23*a* where the second warp yarn 23 moves to the neighboring wale and is not propagated beyond that point. Moreover, as the first warp yarn 22 forms one wale and does not move to the neighboring wale, the chain stitch 21 retains an uninterrupted appearance. And as the second fine warp yarn 23 not greater than 30 deniers traverse between the adjoining 2 wales, the traversing portion 23*a* is not too conspicuous.

When the second warp yarn 23 is knitted at a lower tension as compared with the first warp yarn 22, the run is effectively prevented as follows. Thus, for example, when the warp yarns 22 and 23 constituting the chain stitch 21 in the wale at the right-hand end in FIG. 8 are simultaneously cut and the cut ends of the warp yarns 22 and 23 are pulled in the direction indicated by the arrow-mark P, the new loops of the two warp yarns 22, 23 (the needle loops at top) slip off from the old loop below to initiate a run but as the second warp yarn 23 has a low tension and its length per course is greater than the length of the first warp yarn 22, the slip-off of the second warp yarn 23 is delayed in comparison with that of the first warp yarn so that as the delay is accumulated by several slip-off cycles, the slip-off of the first warp yarn 22 in the B course older than the A course begins before the slip-off of the second yarn 23 in the A course remains to be completed as yet, so that the needle loop 22*a* of the first warp yarn 22 fastens the base of the needle loop 23*b* of the second warp yarn 23 which is about to slip off the A course and, consequently, the run stops before the traversing the point 23*a* is reached. However, for this effect to be realized, the length of the first warp yarn 22 per course must be longer by at least 10 percent than the length of the second warp yarn 23 per course. If the difference is less than 10 percent, the above effect cannot be obtained. If, conversely, the difference is more than 30 percent, there is too great a slack in the fine second yarn 23 to permit knitting and the aesthetic quality of the product lace is adversely affected. By reducing the tension of the finer second warp yarn 23 as mentioned above, the traversing section 23*a* is made less conspicuous and it is made easier to form a large loop such as a net mesh. It is also preferable that the total denier number of the first warp yarn 22 and second warp yarn 23 be set at a value approximating the denier number of the conventional warp yarn or a value slightly greater than the latter. The number of courses in which the second warp yarn 23 forms the chain stitch 21 side by side with the first warp yarn 22 is preferably in the range of 4 to 20. If the number of courses is less than 4, the formation of a net mesh becomes difficult. If, conversely, the number of courses exceeds 20, simultaneous cutting of the two warp yarns 22 and 23 results in a long run. When either one of the first warp yarn 22 and second warp yarn 23 is provided with a coating layer of heat-bonding resin, there is a difference in surface sliding resistance between the two yarns so that when both yarns are simultaneously cut, the slip-off of the coated yarn is delayed to help prevent the run. Further, an expandable warp knitted lace fabric with an elastic yarn such as spandex inserted into each chain stitch 1 is generally liable to run but this run can also be stopped effectively by forming the chain stitch 21 using the warp yarns 22 and 23 described above.

Figure 8:
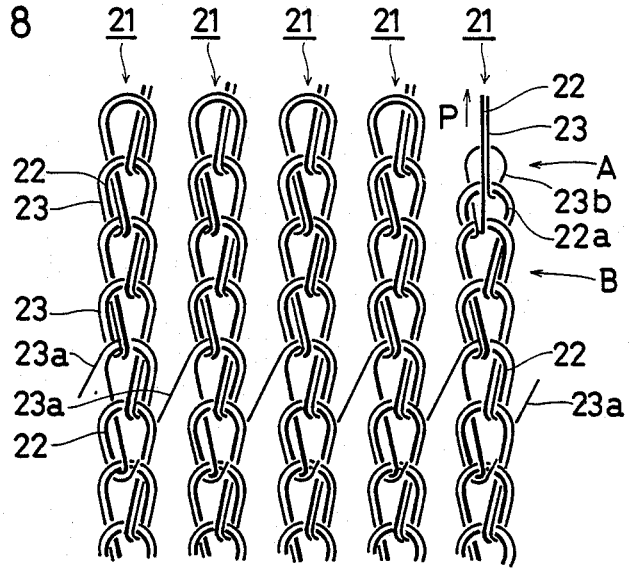
FIG. 8 is an enlarged view showing a warp knitted fabric similar to that of FIG. 3 but differing in that one of the doubled two yarns reciprocates between wales.
Figure 9:
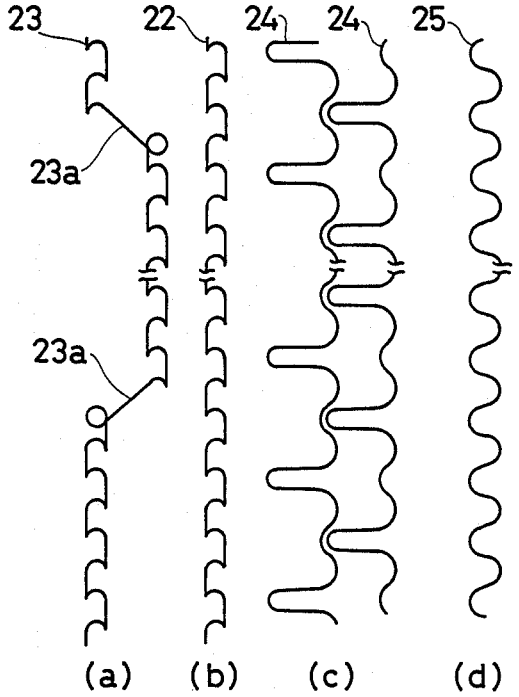
FIG. 9 is a pattern diagram of the fabric according to FIG. 8.

More particularly, the lace knitted fabric illustrated in FIG. 8 was constructed using a 20-denier heat-bonding nylon multifilament yarn as said first warp yarn 22 and a 15-denier nylon multifilament yarn as said second warp yarn 23. Thus, the above-mentioned first warp yarn 22, second warp yarn 23, a 30-denier nylon wooly yarn as the ground insertion yarn 24, and a spandex nylon covering yarn (210-denier) as the elastic yarn 25 were arranged respectively. Then, the second warp yarn 23 is fed to the first reed and as shown in FIG. 9(*a*), 10 courses of chain stitch are made alternatingly by reciprocating the reed between two adjacent wales. The first warp yarn 22 is fed to the second reed and as shown in FIG. 9(*b*), chain stitches are continuously made along one wale to form double chain stitches in all the courses. Further, the ground insertion yarn 24 was fed to the third reed to underlap the adjoining wales every 4 courses to make form open nets. However, the underlappings of the ground insertion threads 24, 24 in the adjoining wales were shifted by two courses. Further, the elastic yarn 25 was fed to the fourth reed and inserted along each wale. The runner length (the length of yarn required to construct 480 courses) of the second warp yarn 23 fed to the first reed was set at 105.5 cm and that of the first warp yarn 2 fed to the second reed was set at 103.5 cm, and the stitch of the second warp yarn 23 was made slightly greater than that of the first warp yarn 22. The density was set at 40 courses/inch (15.7 courses/cm) on the loom and 90 courses/inch (35.4 courses/cm) on the finished fabric, and the fabric was finished in the conventional manner.

What is claimed is:

1. A warp knitted lace fabric comprising a plurality of chain stitches and a ground insertion yarn, pattern yarn and/or other yarn interconnecting said stitches, each of said plurality of stitches being made by at least one heat bonding yarn throughout the fabric, said heat bonding yarn being composed of a core of a lace knitting yarn made of a synthetic fiber fully surrounded by a thermoplastic synthetic resin covering layer having a melting point lower than the melting point of said core yarn, said heat bonding yarn being thermally joined to itself and to other component yarns at intersections.

2. The warp knitted lace fabric according to claim 1, wherein said chain stitches are formed by said heat bonding yarn.

3. The warp knitted lace fabric according to claim 1, wherein said thermoplastic synthetic resin is a polyamide or polyester copolymer resin melting at 110° to 120° C.

4. The warp knitted lace fabric according to claim 3 wherein said heat bonding yarn comprises a nylon filament yarn having a substantially higher melting point than said thermoplastic synthetic resin as a core and a nylon 6-nylon 66-nylon 12 terpolymer as a surface covering.

5. The warp knitted lace fabric according to claim 4 wherein said thermoplastic synthetic resin on a nonvolatile matter basis accounts for 1 to 35 percent by weight of the core filament yarn.

6. The warp knitted lace fabric according to claim 1, wherein said chain stitches are formed by a first yarn consisting in a lace knitting yarn free of a thermoplastic resin covering and a second yarn consisting in said heat bonding yarn.

7. The warp knitted lace fabric according to claim 6 wherein said first and second yarns independently form needle loops.

8. The warp knitted lace fabric according to claim 6 wherein said first and second yarns are doubled to form said chain stitches in common.

9. The warp knitted lace fabric according to claim 8, wherein one of said first and second yarns traverses between a plurality of wales at every 4–20th non-traversing needle loop in a wale and in each wale forms a chain stitch together with the other of said first and second yarns which is not traversing, said one yarn being finer than and longer by at least 10% than the other of said first and second yarns per needle loop in the region of said non-traversing needle loops.

* * * * *